United States Patent [19]

Leifeld

[11] Patent Number: 4,939,815

[45] Date of Patent: Jul. 10, 1990

[54] LAP EVENING APPARATUS FOR A FIBER PROCESSING MACHINE

[75] Inventor: Ferdinand Leifeld, Kempen, Fed. Rep. of Germany

[73] Assignee: Trützschler GmbH & Co. KG, Mönchengladbach, Fed. Rep. of Germany

[21] Appl. No.: 255,258

[22] Filed: Oct. 11, 1988

[30] Foreign Application Priority Data

Oct. 9, 1987 [DE] Fed. Rep. of Germany ..... 3734140

[51] Int. Cl.[5] ..... D01G 23/04

[52] U.S. Cl. ..... 019/105; 019/300

[58] Field of Search ..... 19/64.5, 97.5, 105, 19/296, 300

[56] References Cited

U.S. PATENT DOCUMENTS 4,486,921 12/1984 Leifeld ..... 19/105
4,510,647 4/1985 Keller et al. ..... 19/105
4,694,538 9/1987 Pinto et al. ..... 19/105
4,731,909 3/1988 Duda ..... 19/300 X

FOREIGN PATENT DOCUMENTS 1135346 8/1962 Fed. Rep. of Germany .
2359917 6/1974 Fed. Rep. of Germany .
2939968 4/1981 Fed. Rep. of Germany .
3315909 11/1984 Fed. Rep. of Germany ..... 19/105

*Primary Examiner*—Werner H. Schroeder
*Assistant Examiner*—Sara M. Current
*Attorney, Agent, or Firm*—Spencer & Frank

[57] ABSTRACT

A textile fiber feeder includes a feed chute adapted to be charged with fiber material and having a lower portion constituting a zone in which a fiber lap is formed from the fiber material; a measuring arrangement for measuring a distribution of the fiber material along the feed chute width and for generating signals representing the distribution of material; a sensor member forming part of the measuring arrangement and directly responding to the distribution of fiber material; and arrangement for generating an air flow in the feed chute for affecting the distribution of the fiber material; and a regulating arrangement for controlling the air flow along the feed chute width as a function of the signals. The regulating arrangement includes a setting member arranged for directly altering the air flow. The sensor member and the setting member are arranged in an adjoining relationship in the zone where the fiber lap is formed.

14 Claims, 4 Drawing Sheets

1
2
3
4
5
6
7
8
9
10
11
12
13
14
14a
14b
14c
14d
15
16
17
18
19
20
20a
21
M

FIG.4
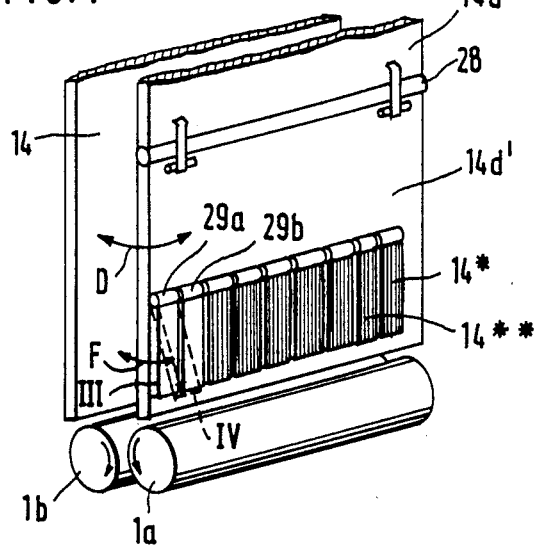
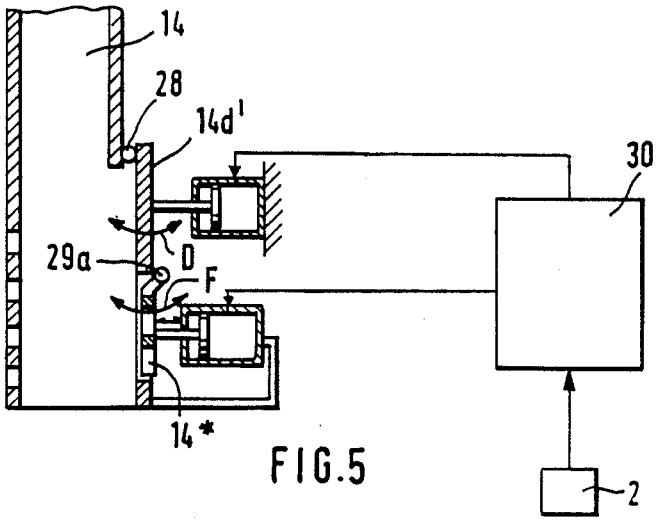
FIG.5

LAP EVENING APPARATUS FOR A FIBER PROCESSING MACHINE

BACKGROUND OF THE INVENTION

This invention relates to an apparatus for evening the fiber lap supplied to the input of a carding machine, a roller card unit, a cleaner or a similar fiber processing machine. The fiber lap is obtained from a fiber tuft feeder (such as a feed chute) which is associated with the fiber processing machine and in which the fiber distribution over the width of the fiber lap discharged by the feed chute is measured and the signals representing the measured values are utilized to automatically regulate the air flow in the feed chute along the width thereof to thus regulate the distribution of material along the feed chute width.

In a known apparatus of the above-outlined type, a significant space is present between the lower end (discharge end) of the feed chute and the downstream-arranged fiber processing machine, such as a card or a roller card unit. The fiber lap which is downwardly withdrawn from the feed chute is fed to the feed roller of the fiber processing machine on a transfer tray. The measuring of the material distribution along the width of the fiber lap is effected by sensing the thickness of the throughgoing material by means of "pedals" arranged parallel to the width of the fiber lap. The setting member is an adjustable air outlet opening which extends along the width of the feed chute and which is divided into adjustable sections, whereby the air outlet passage may be increased or reduced. Because of the distance between the measuring member and the setting member there results an undesired delay of the regulation of the fiber lap, particularly as concerns thickness fluctuations.

SUMMARY OF THE INVENTION

It is an object of the invention to provide an improved apparatus of the above-outlined type, from which the discussed disadvantages are eliminated and which in particular permits a short-term regulation (evening) of the fiber lap which is to be supplied to the input of a card, a roller card unit, a cleaner or a similar fiber processing machine.

This object and others to become apparent as the specification progresses, are accomplished by the invention, according to which, briefly stated, the measuring member for determining the fiber material distribution and the setting member for varying the air flow in the zone where the fiber lap is formed are arranged in the feed chute, adjacent one another.

By virtue of the fact that the measuring member (for example, a contacting sensor) is situated in the vicinity of the setting member (for example, settable air outlet openings) and both are arranged at the end portion of the feed chute, in the zone where the fiber lap is formed, a short-period regulation of the fiber lap to be fed to a card, a roller card unit, a cleaner or a similar fiber processing machine is feasible. A delay between measuring the deviation and the regulation thereof is practically non-existent.

The invention has the following additional advantageous features:

The measuring member is situated in the lower end zone of the feed chute.

The setting member is situated in the lower end zone of the feed chute.

The measuring member is situated in the immediate vicinity of the setting member.

The air outlet openings are divided into individually settable segments; to each individual segment a separate measuring member is assigned which independently senses the thickness values.

The discharge end of the feed chute terminates in the zone of the feed roller of the fiber processing machine whereby the feed roller draws the fiber material from the feed chute.

The setting member is a comb-like plate or an apertured plate.

The setting member is constituted by a rotatably supported feed chute wall portion which has a plurality of independently adjustable air outlet openings along the feed chute width.

The setting members are actuated by pneumatic elements, for example, pneumatic cylinder units. Expediently, for this purpose each pneumatic cylinder cooperates with a gate, a slide or the like which varies the outlet area or the air flow resistance for the air passing through the air outlet openings.

The measuring members are connected by the setting members by means of a control and regulating device.

BRIEF DESCRIPTION OF THE DRAWING

FIG. 4 is a schematic perspective view of still another preferred embodiment of the invention.

FIG. 5 is a schematic partial sectional side elevational view of the construction of FIG. 4, with block diagram, illustrating the electric control of measuring and setting members.

DESCRIPTION OF THE PREFERRED EMBODIMENTS

Figure 1:
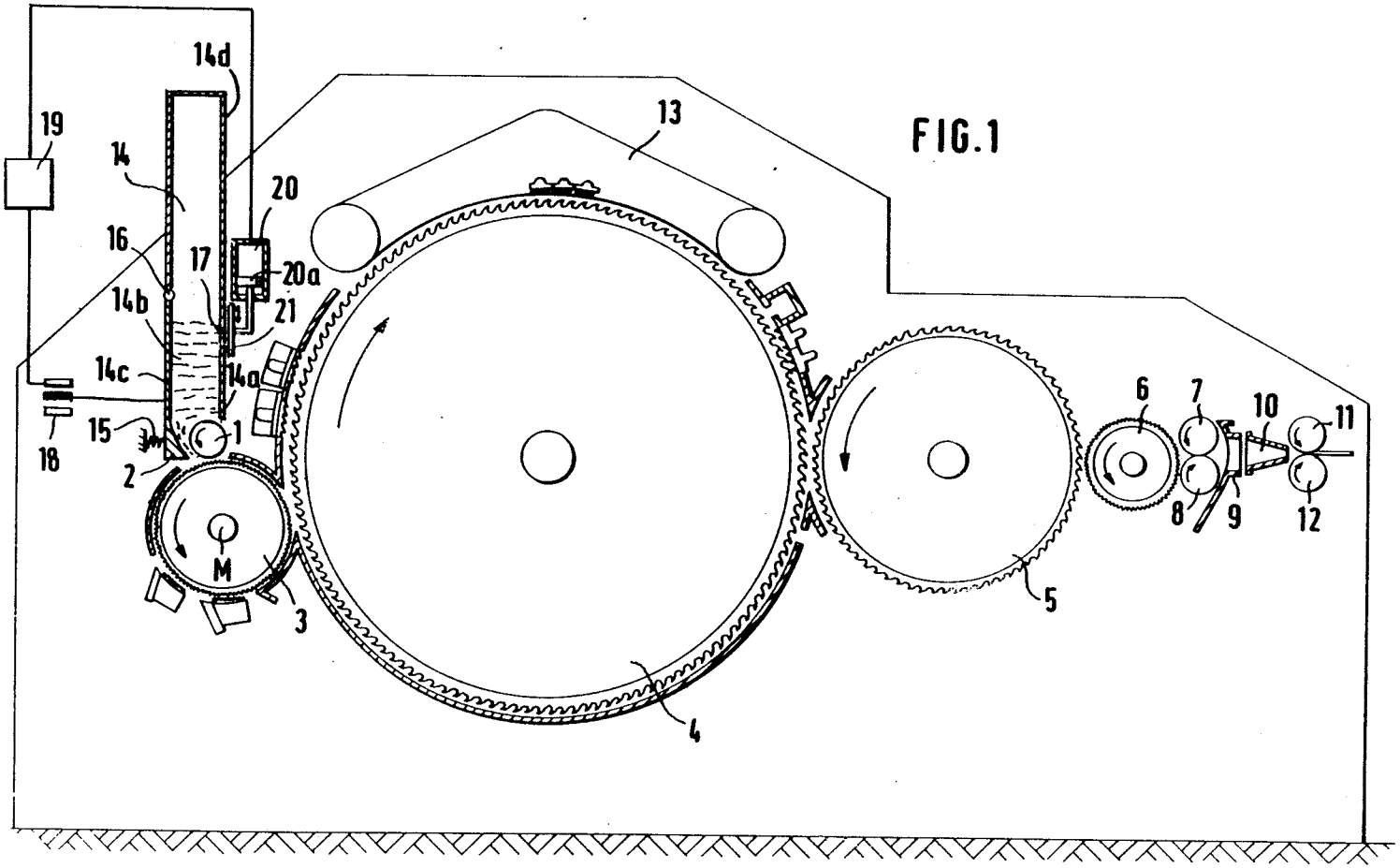
FIG. 1 is a schematic side elevational view of a carding machine with an associated card feeder, incorporating a preferred embodiment of the invention.

Turning to FIG. 1, there is shown therein a carding machine which may be an "EXACTACARD DK 715" model, manufactured by Trützschler GmbH & Co. KG, Mönchengladbach, Federal Republic of Germany. The carding machine has a feed roller 1, a feed table 2, a licker-in 3, a main carding cylinder 4, a doffer 5, stripping rollers 6, crushing rollers 7 and 8, a web guide element 9, a sliver trumpet 10, calender rollers 11 and 12 as well as travelling flats 13.

Upstream of the carding machine there is arranged a fiber tuft feeder (feed chute) 14 whose lower end **14*a* terminates at the feed roller 1, as a result of which the feed roller 1 is capable of withdrawing the fiber material from the feed chute 14. The latter is arranged approximately vertically above the generally horizontally oriented rotary axis M of the licker-in 3. The feed roller 1 cooperates with the feed table 2 which is arranged at the lower end of the feed chute wall 14*c* and is biased by a spring 15 in the direction of the feed roller 1. The feed chute wall 14*c* is swingably held by means of a hinge 16. In the zone of the lower end of the feed chute wall 14*d* there are provided air outlet openings 17** which may be constituted by holes or by a comb-like wall construction.

The feed table 2 is associated with an inductive path sensor 18 which measures the thickness fluctuations of the fiber tuft material 14b in the feed chute 14 as a function of the excursions of the resiliently held feed table 2 and converts the signals generated by the path sensor 18 into electric pulses. The path sensor 18 is connected to a pressure cylinder unit 20 with the intermediary of a regulating device 19. The pressure cylinder unit 20 has a piston 20a to which there is secured a vertically oriented cover plate 21 which may be displaced upwardly or downwardly by the cylinder unit 20 to cover to a greater or lesser extent the air outlet openings 17. In this manner, the measuring member (that is, the feed table 2 and the inductive path sensor 18) for the fiber material distribution and the setting member (that is, the pressure cylinder unit 20 and the cover plate 21) are arranged in the zone where the fiber lap is formed in the feed chute. The measuring member (that is, the feed table 2) is arranged in the immediate vicinity of the setting member (that is, the cover plate 21).

Figure 2:
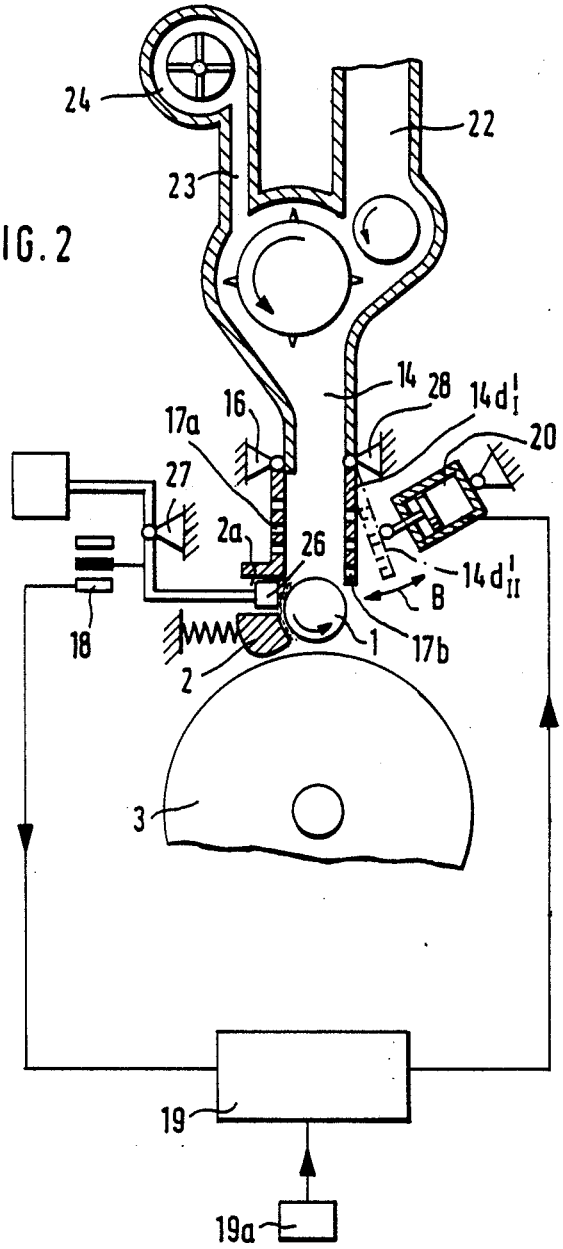
FIG. 2 is a schematic side elevational view of the preferred embodiment showing additional details.

Turning now to FIG. 2, above the licker-in 3 there is arranged a dual-chute card feeder which may be, for example, an "EXACTAFEED FBK" model, manufactured by Trützschler GmbH & Co. KG. The feeder has an upper or reserve chute 22 and a lower or feed chute 14. To the air duct 23 there is connected a blower 24 which drives a compressing air stream downwardly to densify the fiber tufts 14b in the feed chute 14. The compressing air exits the feed chute through air outlet openings 17a and 17b. In the feed table 2 there is provided an aperture 2a in which there is disposed a sensor element 26 movably supported by means of a pivotal support device 27. The sensor element 26 is connected with an inductive path sensor 18. The feed chute wall 14d is swingably supported in its lower zone 14d' by means of a pivotal support 28. The feed chute portion $14d_I$ may be swung into the position $14d'_{II}$ as indicated by the double-headed arrow B. The apparatus includes a regulating circuit which comprises the sensor element 26 at the feed chute 14 which cooperates with the feed roller 1 and which, at the same time, serves as a withdrawing roller at the lower end of the feed chute 14. The lower chute wall 14d' functions as a setting member which is moved by the pressure cylinder unit 20 (pneumatic setting element). Between the measuring member and setting member a regulator 19 is operatively connected to which there is applied the desired value for the basic setting position of the chute wall 14d' by a desired value setter 19a.

Figure 3:
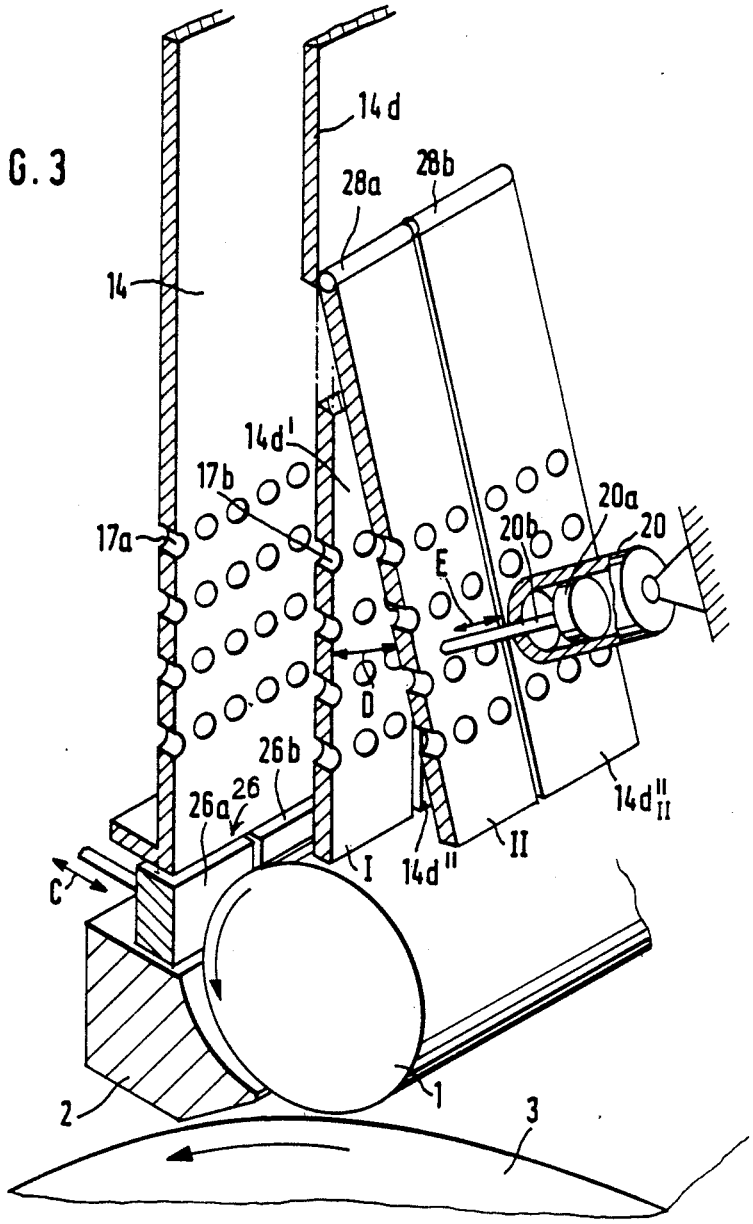
FIG. 3 is a sectional schematic perspective view of another preferred embodiment of the invention.

Turning now to the embodiment illustrated in FIG. 3, a sensor 26 is arranged along the width of the fiber tuft feeder 14. The lower feed chute wall 14d' is subdivided into a plurality of mutually independent individual segments 14d', 14d''. The sensor 26 which cooperates with the feed roller 1 as well as the lower zone of the feed chute 14d are divided into individual segments. Thus, a plurality of measuring elements (sensor segments) 26a, 26b and a plurality of setting members 14d', 14d'' are provided; with each setting member 14d', 14d'' (constituted by chute wall segments) a measuring segment 26a, 26b is associated. The sensor elements 26a and 26b are arranged in the immediate vicinity of the setting members 14d', 14d'' and both the sensor elements and the setting members are arranged in that zone of the feed chute 14 where the fiber lap is formed from the fiber tufts. The pneumatic fiber tuft compressing device in the feed chute 14 of the dual-chute card feeder assists, together with the gravity acting on the material, the withdrawing and transporting behavior in the system comprising the feed roller 1 and the feed table 2.

The double-headed arrow C indicates the direction of motion of the sensor elements 26a, 26b. The double-headed arrow D illustrates the direction in which the setting members 14d', 14d'' are moved about the rotary joints 28a and 28b, respectively, from the position I into the position II and conversely. The double-headed arrow E indicates the direction in which the piston 20a and the piston rod 20b are movable which are connected with the segment 14d' of the setting member. Each segment is associated with a separate pressure cylinder.

Turning now to the embodiment illustrated in FIG. 4, the feed chute wall 14d' is rotatable about the hinge 28. The wall 14d' has a plurality of mutually independently movable segments 14*, 14, each provided with air outlet openings (such as slots between comb tines) along the width of the feed chute. The segments 14*, 14** are swingably held by rotary joints 29a and 29b, respectively. In this embodiment a mechanically dual adjustability of the feed chute wall 14 is shown. On the one hand, the feed chute wall zone 14d' can be adjusted about the rotary joint 28; in the lower zone of the chute wall range 14d' the individual segments 14*, 14** are supported on the rotary joints 29a and 29b, respectively. The segments 14*, 14** are, in turn, also settable independently from one another. The feed chute wall 14d' and the segments 14*, 14** form the setting members. The double-headed arrow F shows the direction of motion in which the individual segments 14*, 14** can be moved about the rotary joints 29a and 29b** from the position III into the position IV and conversely.

Turning now to the embodiment illustrated in FIG. 5, there is shown how the dual adjustability of the FIG. 4 construction, that is, the adjustability of the chute wall zone 14d' and the individual element segments 14*, 14 are interconnected by means of a microcomputer 30. In this manner, the carrier wall (feed chute wall zone 14d') and the individual systems (individual segments 14*, 14**) may form part of a regulating circuit and function as setting members or may be brought into position in an automatic manner. Reference numeral 2** designates the measuring member, such as a feed table.

Curved arrows drawn into the rollers show the direction of rotation thereof.

The present disclosure relates to subject matter contained in Federal Republic of Germany Patent Application No. P 37 34 140.5 (filed Oct. 9th, 1987) which is incorporated herein by reference.

It will be understood that the above description of the present invention is susceptible to various modifications, changes and adaptations, and the same intended to be comprehended within the meaning and range of equivalents of the appended claims.

What is claimed is:

1. In a textile fiber feeder including a feed chute adapted to be charged with fiber material, said feed chute having a width, a lower portion constituting a zone in which a fiber lap is formed from the fiber material and an outlet opening through which the fiber lap is discharged; said outlet opening being situated in said zone;

measuring means for measuring a distribution of the fiber material along the feed chute width and for generating signals representing said distribution;

said measuring means including a sensor member directly responding to said distribution of fiber material;

means for generating an air flow in the feed chute for affecting said distribution of the fiber material and causing densification thereof;

means defining air outlet openings in said feed chute in said zone for guiding said air flow out of said feed chute; and regulating means for controlling the air flow along the feed chute width as a function of said signals; said regulating means including a movably supported setting member and force-exerting means connected to said setting member for changing the orientation thereof in response to a change of said signals, whereby said air flow is directly altered by said setting member as a function of said signals;

the improvement wherein said sensor member and said setting member are arranged in an adjoining relationship in said zone.

2. A textile fiber feeder as defined in claim 1, wherein said sensor member is situated at said outlet opening.

3. A textile fiber feeder as defined in claim 1, wherein said outlet opening is situated in said zone, and said setting member is situated at said outlet opening.

4. A textile fiber feeder as defined in claim 1, wherein said sensor member is situated immediately next to said setting member.

5. A textile fiber feeder as defined in claim 1, wherein said setting member is present in a plurality; each setting member being formed of movable feed chute segments arranged side-by-side along said width, and each segment comprising at least some of said air outlet openings; said sensor member being present in a plurality; with each said segment there being associated a separate sensor member.

6. A textile fiber feeder as defined in claim 1, wherein said setting member comprises a plate having a plurality of perforations constituting at least some of said air outlet openings.

7. A textile fiber feeder as defined in claim 1, wherein said setting member comprises a plate having a plurality of serially arranged tines in a comb-like configuration; adjoining tines being spaced from one another to define said air outlet openings.

8. A textile fiber feeder as defined in claim 1, wherein said feed chute has a lower wall portion subdivided into a plurality of segments arranged side-by-side parallel to the feed chute width; joint means for movably supporting each segment independently from one another; said segments defining at least some of said air outlet openings for allowing the air flow to exit from the feed chute at a rate determined by positions of said segments; said segments constituting said setting member; further wherein said regulating means includes power means for displacing said segments independently from one another.

9. A textile fiber feeder as defined in claim 1, wherein said regulating means further comprises a control device operatively connecting said measuring means to said setting member for varying the rate of air exiting from said feed chute in response to the material distribution determined by said measuring means.

10. A textile fiber feeder as defined in claim 1, wherein said feed chute has a lower wall portion defining therein at least some of said air outlet openings; said setting member comprises a plate in a face-to-face relationship with said lower wall portion; said plate being slidable to vary the area of coverage of the air outlet openings by said plate.

11. A textile fiber feeder as defined in claim 1, wherein said feed chute has a lower wall portion; first joint means for movably supporting said lower wall portion; said lower wall portion having a terminal part subdivided into a plurality of segments arranged side-by-side parallel to the feed chute width; second joint means for movably supporting each segment independently from one another; said segments defining at least some of said air outlet openings for allowing the air flow to exit from the feed chute at a rate determined by positions of said segments; said lower wall portion, including said segments, constituting said setting member; further wherein said regulating means includes power means for displacing said lower wall portion and said segments.

12. A textile fiber feeder as defined in claim 11, wherein said power means comprise separate pneumatic power elements connected to said lower wall portion and said segments.

13. A textile fiber feeder as defined in claim 1, in combination with a fiber processing machine having a feed roller situated at the outlet opening of the feed chute and arranged to withdraw the fiber lap therefrom and to advance the fiber lap to the fiber processing machine; said sensor member cooperating with said feed roller.

14. A textile fiber feeder as defined in claim 13, wherein said fiber processing machine is a carding machine.

* * * * *